United States Patent [19]

Bauman et al.

[11] 4,128,485

[45] Dec. 5, 1978

[54] FABRIC SOFTENING COMPOUNDS

[75] Inventors: Robert A. Bauman, New Brunswick; James A. Kaeser, Somerset, both of N.J.

[73] Assignee: Colgate-Palmolive Company, New York, N.Y.

[21] Appl. No.: 860,034

[22] Filed: Dec. 12, 1977

Related U.S. Application Data

[63] Continuation-in-part of Ser. No. 714,871, Aug. 16, 1976, abandoned.

[51] Int. Cl.[2] ..... D06M 11/04

[52] U.S. Cl. ..... 252/8.8; 260/404.5 Q; 260/459 A; 260/567.6 M; 560/253

[58] Field of Search ..... 252/8.8 AJ; 260/404.5 Q, 459 A, 482 R, 567.6 M

[56] References Cited

U.S. PATENT DOCUMENTS

| | | | |
|---|---|---|---|
| 2,963,339 | 12/1960 | Keller | 260/404.5 Q |
| 3,048,539 | 8/1962 | Kocay et al. | 252/8.9 |
| 3,356,526 | 12/1967 | Waldman et al. | 260/567.6 M |
| 3,873,583 | 3/1975 | Walz et al. | 260/404.5 Q |

*Primary Examiner*—William E. Schulz

*Attorney, Agent, or Firm*—Richard N. Miller; Murray M. Grill; Herbert S. Sylvester

[57] ABSTRACT

A new class of nitrogen compounds having an amide or ester linkage therein that are useful alone as softeners and in laundry detergent formulations.

11 Claims, No Drawings

FABRIC SOFTENING COMPOUNDS

This application is a continuation-in-part of application Ser. No. 714,871, filed Aug. 16, 1976 and now abandoned.

BACKGROUND OF THE INVENTION

This invention relates to new quaternary ammonium compounds, more particularly, to such compounds having an ester or amide linkage therein which are suitable for use as fabric softeners and as compounds in laundry detergent formulations.

Although cationic fabric treating softening agents are extensively used, they generally have a marked tendency to impart a yellowness to fabrics which are continually treated with the same. Furthermore, the cationic fabric softening agents generally can be utilized only in the rinse cycle since the majority of commercially available detergents are of the anionic type and are not compatible with these cationic fabric softening agents. It would be desirable to be able to utilize such cationic agents both in the rinse cycle and in the wash without causing the fabrics to become yellowed and without substantially interfering with the detergent when suitably combined therewith.

In addition to yellowness that is often imparted by many cationic fabric softening agents, the fabrics are often also stained by metal cations present in various soils, especially clay type soils. One means for treating these metal type stains is the removal of the stains subsequent to their setting on the fabrics by way of bleaching and repeated washing. Each of these treatments, of course, is not completely satisfactory since continued bleaching of fabrics tends to degrade the same and to shorten their useful life. The continued washing is not completely effective in removing the stains and tends to impart a certain board-like feel to the fabrics, thus necessitating the use of fabric softener.

Accordingly, it is within the above framework that the instant compounds have been synthesized, compositions employing the same developed and processes for their production as well as for treating fabrics developed.

Broadly speaking, the instant invention includes the provision of a compound having the formula $[C_nH_{2n+1}COR(CH_2)_mN^+(CH_3)_2C_pH_{2p+1}]X^-$ wherein R is a moiety selected from the group consisting of O and NH, $n$ is an integer of about 11–22, $m$ is an integer of about 2–6 and $p$ is an integer of about 10–20, X is an anion, i.e., halide, methosulfate, ethosulfate, and the like, such that the compounds are water dispersible or soluble; methods of preparing the same, including a method of preparing the compound comprising reacting (a) an acyl halide in the presence of an inert organic solvent with (b) a desired dialkylaminoalkanol or an unsymmetrical dialkyl alkylenediamine and therafter quaternizing the intermediate thus produced with sufficient (c) quaternizing agent by heating; compositions embodying the compounds and methods of use thereof.

The preparation of the intermediate ester or amide compounds may conveniently be carried out at temperatures of about −10° to 100° C., preferably about 15° to 30° C., for about 1 to 24 hours, or for a sufficient period of time until the desired ester or amide is formed. The reaction may be carried out in conventional equipment with no particular significant precautions being taken beyond those customarily employed when working with materials of this nature.

In carrying out the reaction to produce the amide, about one mole of acyl halide is reacted with about 2 to 3 moles of dialkyl alkylene diamine to form the dialkyl amino alkyl amide which is thereafter quaternized with a sufficient amount of quaternizing agent, preferably in equimolar amount, for a sufficient period of time to effect quaternization, e.g., about 1 to 24 hours, preferably about 2 to 4 hours, at a sufficient temperature, about 60° to 110° C., preferably about 90° to 100° C.

In preparing the ester, about 1 mole of acyl halide is reacted with about 2 to 4 moles, preferably 2 to 2.5 moles, dialkyl amino alkanol to form the intermediate dialkyl amino alkyl ester; the reaction being carried out at sufficient temperature, about 20° to 100° C., preferably about 20° to 30° C., for a sufficient period of time. The thus produced intermediate is then effectively quaternized with a suitable amount of quaternizing agent, e.g., an equimolar amount, although an excess of either reactant may also be used, for a sufficient time, e.g., about 1 to 24 hours, preferably about 2 to 3 hours, at sufficient temperature, e.g., about 60° to 110° C., preferably about 90° to 100° C. to complete the same.

The intermediate reaction is preferably carried out in a solvent, the amount of which employed is not particularly critical. It should, however, be chosen such that it is inert to the reactants. Suitable solvents are inert organic solvents which are liquid under reaction conditions. Solvents which are useful in the present invention are aliphatic alicyclic hydrocarbons containing at least 5 carbon atoms and preferably from about 5 to about 10 carbon atoms, such as hexane, cyclohexane, heptane, octane and the like; carbon tetrachloride and mixtures of carbon tetrachloride with said aliphatic and alicyclic hydrocarnons; ethers, aromatic hydrocarbons, expecially those containing about 6 to 12 carbon atoms can also be employed. For example, mixtures of aliphatic or alicyclic solvents with aromatic solvents such as benzene, toluene, xylene and the like would be suitable.

In carrying out the quaternization reaction, many suitable quaternizing agents may be employed. The intermediate produced in the reaction is thus submitted to a treatment conducive to quaternization of the tertiary amino group, utilizing a conventional quaternizing agent. Thus, noting the above structural formula for the compound, suitable quaternizing agents include dialkyl sulfates, e.g., dimethyl sulfate, diethyl sulfate, etc.; alkyl arenesulfonate, e.g., methyl p-toluenesulfonate; alkyl halide, etc. Accordingly, any conventional quaternizing agent can be advantageously employed.

The above-noted compounds find particular utility as non-yellowing fabric softeners that may be employed in the rinse cycle, in combination with suitable detergent formulations in the wash cycle, and as a liquid concentrate to be applied to the clothing.

The compounds of the present invention are suitably employed as a softener in concentrations of about 1–25%, preferably about 2 to 20% by weight in a solution of water.

The compounds may also be employed in dried form (e.g., powder) by combining the same with a suitable inorganic salt, zeolite, phosphate builder, etc., in a ratio of about 1:1 to 1:100, preferably about 1:2 to 1:50. Expressed another way, the compounds are particularly suitable if employed in the wash at about 1–15 gms., preferably about 2 to 10 gms. per 8-pound load of clothes.

The compounds may also be combined with a suitable synthetic organic detergent, preferably a nonionic, though anionics may also be employed, in a ratio of about 1:1 to 1:10, preferably about 1:2 to 1:5, compound to detergent.

Although the solvent for the compounds utilized in the process of the present invention is normally water, the water may be mixed with non-aqueous alcohols, glycols, etc., or mixtures with water.

In addition to the solvent and the aforesaid compounds, compositions of the present invention may also include up to about 40% of an optional nonionic or anionic surface active agent, such as about 5 to 40%, preferably about 8 to 30% by weight.

Representative nonionic detergents include alkaryl polyglycol detergents such as alkyl-phenol-ethylene oxide condensates (2–100 moles ethylene oxide), e.g., p-isotcyl phenol-polyethylene oxide (10 ethylene oxide units), long-chain alcohol ethylene oxide condensation products (2–200 moles ethylene oxide), e.g., dodecyl alcohol-polyethylene oxides having 4 to 16 ethylene oxide units per molecule, polyglycerol monolaurate, glycol dioleate, sorbitan monolaurate, sorbitan monostearate, sorbitan monopalmitate, sorbitan monooleate, sorbitan sesquioleate, the condensation products of ethylene oxide with sorbitan esters of long-chain fatty acids (Tweens), alkylolamides, amine oxides, phosphine oxides, etc.

In addition to the above-noted nonionic detergents, anionic detergents may also be utilized in the composition and process of the present invention. Suitable anionic detergents include alkyl-benzene-sulfonic acid and salts, having the formula alkyl-phenyl-$SO_3$-M, wherein alkyl is an alkyl radical of a fatty acid and M is hydrogen or an alkali metal, which compounds comprise a well-known class of anionic detergents. Other suitable anionic detergents are the alkali metal salts of the higher alkyl and linear paraffin sulfonic acids; the alkali metal dialkylsulfosuccinates, e.g., sodium dioctylsulfosuccinate and dihexylsulfosuccinate; sodium tetradecanesulfonate; sodium diisopropylnaphthalenesulfonate; sodium octylphenoxyethoxyethylsulfonate; and the alkali metal alkyl sulfates.

Among the above-noted alkylbenzene-sulfonic acid and salts thereof, there are included those which are biodegradable which are particularly characterized by a linear alkyl substituent of about $C_{10}$ to $C_{22}$ and preferably about $C_{12}$ to $C_{15}$. It is, of course, understood that the carbon chain length represents, in general, an average chain length since the method for producing such products usually employs alkylating reagents of mixed chain length. It is clear, however, that substantially pure olefins as well as alkylating compounds used in other techniques can and do give alkylated benzene sulfonates; wherein the alkyl moiety is substantially (i.e., at least 99%) of one chain length, i.e., $C_{12}$, $C_{13}$, $C_{14}$ or $C_{15}$. The linear alkyl benzene sulfonates are further characterized by the position of the benzene ring in the linear alkyl chain, with any of the position isomers (i.e., alpha to omega) being operable and contemplated.

In addition to the benzene sulfonates one may also employ the lower alkyl ($C_1$ to $C_4$) analogs of benzene such as toluene, xylene, the trimethyl benzenes, ethylbenzene, isopropyl benzene and the like. The sulfonates are generally employed in the water-soluble salt form which includes as the cation, the alkali metals, ammonium and lower amine and alkanolamine.

Examples of suitable linear alkyl benzene sulfonates include: sodium n-decylbenzenesulfonate, sodium n-dodecylbenzenesulfonate, sodium n-tridecylbenzenesulfonate, sodium n-tetradecylbenzenesulfonate, sodium n-pentadecylbenzenesulfonate, sodium n-hexadecylbenzenesulfonate and the corresponding lower alkyl substituted homologues of benzene as well as the salts of the cations previously referred to. Mixtures of these sulfonates may, of course, also be used with mixtures which may include compounds wherein the linear alkyl chain is smaller or larger than indicated herein provided that the average chain length in the mixture conforms to the specific requirements of about $C_{10}$ to $C_{22}$.

The linear paraffin sulfonates are also a well-known group of compounds and include water-soluble salts (alkali metal, amine, alkanolamine, and ammonium) of 1-decanesulfonic acid, 1-dodecanesulfonic acid, 1-tridecanesulfonic acid, 1-tetracanesulfonic acid, 1-pentadecanesulfonic acid, 1-hexadecanesulfonic acid as well as the other position isomers of the sulfonic acid groups.

In addition to the paraffin sulfonates illustrated above, others with the general range of about $C_{10}$ to $C_{22}$ alkyls may be used with the most preferable range being about $C_{12}$ to $C_{20}$.

The linear alkyl sulfates which are contemplated in the process and composition of the present invention have alkyl groups in the range of about $C_{10}$ to $C_{22}$. Specific examples include sodium n-decyl sulfate; sodium n-dodecyl sulfate; sodium n-hexadecyl sulfate; sodium n-heptadecyl sulfate; sodium n-octadecyl sulfate; and ethoxylated (1 to 100 moles ethylene oxixde) derivatives thereof. Of course, other water-soluble, salt-forming cations mentioned above may be used.

The above composition may be applied to the fabric according to the process of the present application by any of a number of methods. The solution may be padded or sprayed onto the fabric utilizing either a mechanical spraying apparatus including a pump valve or an aerosol spray wherein the composition includes an effective amount of an aerosol propellant. Also, the composition may be sprinkled on the fabrics or the solution of the same added to the rinse cycle.

The propellant used in connection with the subject invention may be any liquefiable propellant suitable for use in connection with dispensing the material. That is to say, any volatile organic material which exists as a gas at the temperature of use (and ambient or atmospheric pressure) and which exists as a liquid at the same temperature under super-atmospheric pressures can be used as the gas-producing agent. Especially suitable are the $C_3$–$C_6$ aliphatic hydrocarbons, namely, liquefied propane, n-butane, isobutane, isobutylene, n-pentane, isopentane, n-hexane, and hexane-2; and halogenated aliphatic hydrocarbons which contain from 1 to 2 carbon atoms and include, by way of example, methylene chloride, "Freons" such as dichlorodifluoromethane, monochlorodifluoromethane, difluoroethane, difluoromonochloroethane, trichlorotrifluoroethane, monofluorodichloromethane, monofluorodichloroethane, pentafluoromonochloroethane, cyclic octafluorobutane, and mixtures of two or more thereof. Preferably the saturated hydrocarbons and halogenated aliphatic hydrocarbons are employed in the subject composition. The preferred propellant for use in connection with the subject composition is a mixture of dichlorodifluoromethane and trichloromonofluoromethane in a 35:65 blend.

In addition to the aforedefined detergents, the compositions of the present invention may contain one or more water-soluble detergency builder salts either of the organic or the inorganic type.

Examples of water-soluble inorganic detergency builder salts are alkali metal carbonates, bicarbonates, phosphates, polyphosphates, sulfates, borates and silicates, etc. Specific examples of such salts are sodium, potassium and lithium tripolyphosphates, carbonates, pyrophosphates, orthophosphates and hexametaphosphates; sodium, potassium and lithium sulfates, sodium, potassium and lithium silicates; sodium carbonate, bicarbonate, sesquicarbonate, sodium tetraborate and mixtures thereof. Examples of organic alkaline detergency salts are (1) alkali metal amino polycarboxylates (e.g., sodium and potassium ethylenediaminetetraacetates, N-(2-hydroxyethyl)-ethylenediaminetriacetates, nitrilo triacetates, and N-(2-hydroxyethyl)-nitrilo diacetates; (2) alkali metal salts of phytic acid (e.g., sodium and potassium phytates--see U.S. Pat. No. 2,739,942); (3) water-soluble salts of ethane-1-hydroxy-1,1-diphosphonate (e.g., the trisodium and tripotassium salts--see U.S. Pat. No. 3,159,581); (4) water-soluble salts of methylene diphosphonate and the other salts described in U.S. Pat. No. 3,213,030; (5) water-soluble salts of substituted methylene diphosphonic acids (e.g., trisodium and tripotassium ethylidene, isopropylidene, benzylmethylidene, and halomethylidene diphosphonates; (6) water-soluble salts of polycarboxylate polymers and copolymers (e.g., polymers of itaconic; aconitic acid; maleic acid; mesaconic acid; fumaric acid; methylene malonic acid; and citraconic acid and copolymers with themselves and other compatible monomers such as ethylene); and mixtures thereof. Similarly, mixtures of organic and inorganic builder salts are also contemplated by instant invention.

In the detergent composition of the present invention, the active compound is generally employed in an amount of about 5 to 30% by weight of the total composition. While the water-soluble detergency builder salts may where included comprise about 70 to 95% by weight of the total composition, preferably, the compounds comprise about 10 to 25% by weight, while the detergent builders comprise from about 75 to 90% of the total composition.

Various adjuvants may be present in the detergent to give it additional desired properties, either of functional or aesthetic nature. Thus, there may be included in the formulations soilsuspending or anti-redeposition agents, e.g., polyvinyl alcohol, sodium carboxymethylcellulose, hydroxymethylcellulose; optical brighteners, e.g., cotton, amide and polyether brighteners, supplemental synthetic organic detergents, e.g., sodium lauryl sulfate; myristyl polyoxyethylene ethanol, wherein the polyoxyethylene chain is 10 units or longer; linear tridecyl benzene sulfonate; pH adjusting agents, e.g., sodium borate, sodium bisulfate; other inorganic builders, e.g., borax, enzymes, e.g., protease, amylase; thickeners, e.g., gums, alginates, agar-agar; foam destroyers, e.g., silicones; bactericides, e.g., tetrachlorosalicylanilide; fungicides; dyes; pigments (water-dispersible); perservatives; ultra-violet absorbers; pearlescing agents; opacifying agents, e.g., behenic acid, polystyrene suspensions, caster wax; and perfumes. In the selection of adjuvants, they will be chosen to be compatible with the main constituents of the detergent.

Generally, the proportion of such adjuvants will be maintained as low as feasible, almost always being less than 20% of the composition, frequently less than 10% thereof, and preferably, less than 5% thereof in total. Normally, there will be present no more than 5% of any such material and preferably, in most cases, the amount of adjuvant will be less than 2%.

The compounds may be present in the final diluted rinse solution in an amount of about 0.001 to 0.010% by weight and preferably about 0.005 to 0.010% by weight. Of course, it will be most convenient to utilize a concentrated solution for consumer convenience and packaging economies. Generally, since most toploading washing machines have from 15-to-20-gallon capacity, the concentrated form will generally comprise about 2 to 10% by weight in a water solution. The important parameter is the dilution concentration so any concentrate composition will be solely for convenience in use.

Furthermore, the process of the present invention is not basically temperature dependent and performs well using cold and warm water rinse solutions. Also, the process can be conducted using water of any reasonable degree of hardness although, obviously, the use of softer rinse water is preferred.

In washing fabrics, the addition of the fabrics and the detergent composition can be conducted in any suitable conventional manner. Thus, for example the fabrics can be added to the container or washer either before or after the washing solution is added. The fabrics are then agitated in the detergent solution for varied periods of time, a wash cycle of from 8 to 15 minutes being generally used in the washing cycle of an automatic agitator-type washer. Following the washing of the fabrics the detergent composition is drained off of the fabrics and the fabrics are rinsed in substantially clear water. Here again, as a matter of choice, the fabrics can be rinsed as many times as desired. After rinsing the fabrics, the fabrics are dried first by spinning and then by contact with the air as in conventional hanging of the fabrics on a clothesline or in an automatic dryer-type system.

In the preparation of the novel detergent compositions of the present invention, generally, the organic detergent and novel compounds as well as the builders and any minor ingredients are incorporated into the composition prior to its conversion into the final product form, e.g., detergent granules, flakes, bar, etc. However the individual components of the novel detergent composition of the present invention can be added in the form of particles or directly as a liquid to produce a liquid detergent composition.

The composition of the present invention will now be more fully illustrated by way of the following specific examples which are for the purpose of illustration only and are in no way to be considered as limitive of the composition of the present invention. In the following examples, all parts and percentages are by weight and all temperatures in degrees Celsius.

EXAMPLE I

Preparation of N-(3-octadecanamidopropyl)-N,N-dimethyloctadecanaminium bromide.

A solution of 250 g (2.5 moles) N,N-dimethylpropylenediamine in 1.5 liters benzene was stirred and cooled during the dropwise addition of 1 mole of octadecanoylchloride in 400 ml benzene. After standing overnight at room temperature, the reaction mixture was poured into a solution of 100 g sodium hydroxide in 2 liters of water. The precipitate was filtered and recrystallized from ethyl alcohol. 37 g (0.1 mole) of this N-(3-dimethyl-amino propyl) octadecanamide was mixed with 37 g (0.11 mole) 1-bromooctadecane and kept in an oven at 100° C. for 3 hours. The reaction mixture, which solidified at room temperature, was recrystallized from ethyl acetate. By argentimetric titration the product contained 11.30% Br (theory 11.38%).

EXAMPLE II

Preparation of N-(3-octadecanoyloxypropyl)-N,N-dimethyloctadecanaminium bromide.

To a solution of 0.2 mole octadecanoylchloride in 400 ml ethyl ether was added a solution of 32 g (0.31 mole) 3-dimethylamino-1-propanol in 50 ml ethyl ether. After stirring about 2 hours, the reaction mixture was filtered and the solid recrystallized from ethyl acetate. It was converted to the free base, 3-dimethylaminopropyl octadecanoate, with sodium hydroxide and recrystallized from acetonitrile. A mixture of 18.3 g (0.049 mole) of this amine and 16.2 g (0.049 mole) of 1-bromooctadecane was heated in an oven at 100° C. for 7 hours. After washing with ethyl ether to remove any unreacted material the product was recrystallized from ethyl alcohol and washed with ethyl acetate.

By argentimetric titration it contained 11.33% Br (theory 11.36%).

EXAMPLE III

The procedure of Example I is repeated employing 1-bromododecane instead of 1-bromooctadecane to provide N-(3-octadecanamidopropyl)-N,N-dimethyldodecanaminium bromide as the softener compound.

EXAMPLE IV

The procedure of Example I is repeated employing palmitoylchloride and N,N-dimethylethylenediamine to form the intermediate which is subsequently quaternized with 1-bromodocosane.

EXAMPLE V

The procedure of Example I is repeated employing N-(3-dimethylaminopropyl) stearamide and 1-chlorotetradecane as the reactants to form N-(3-octadecanamidopropyl)-N,N-dimethyltetradecanaminium chloride.

EXAMPLE VI

The procedure of Example I is repeated employing N-(3-dimethylaminopropyl)hexadecanamide and tetradecyl methanesulfonate to form N-(3-hexadecanamidopropyl)-N,N-dimethyltetradecanaminium methanesulfonate.

EXAMPLE VII

The procedure of Example II is repeated employing lauroyl chloride and 2-dimethylaminoethanol to form 2-dimethylaminoethyl laurate. When the intermediate is quarternized with 1-bromodecane, the softening compound produced is N-(2-dodecanoyloxyethyl)-N,N-dimethyldodecanaminium bromide.

EXAMPLE VIII

The procedure of Example II is repeated employing as the intermediate N-(3-dimethylaminopropyl)tetradecanamide and as the quaternizing agent 1-bromodocosane.

EXAMPLE IX

The procedure of Example I is repeated employing 6-dimethylaminohexyl stearate and 1-chlorohexadecane as the quaternizing reactant to form N-(6-octadecanoyloxyhexyl)-N,N-dimethylhexadecanaminium chloride.

EXAMPLE X

The procedure of Example II is repeated employing as the intermediate tertiary amine 3-(N-dodecyl-N-methylamino) propyl stearate and as the quaternizing agent dimethyl sulfate.

EXAMPLE XI

The procedure to evaluate softening is carried out as follows:

Tergotometer Test for Rinse — Cycle Softening Agents:

Materials:

3 inch × 6 inch White — Terrycloth Swatches

Standard phosphate detergent based upon Cold Power® or Ajax®

Softening agent (may be present in finished softener formula, but normally tested as is)

Procedure:

1. For each softening agent or different concentration of a softening agent to be examined, label four (4) terrycloth swatches.
2. Add the four swatches to a Tergotometer bucket containing 1.5 g detergent per liter of 49° C. tap water. Agitate for 10 minutes.
3. Remove swatches from bucket; squeeze dry. Empty bucket and return swatches to it.
4. Add 1 liter of 32° C. tap water to bucket, then add softening agent. Agitate 5 minutes.
5. Remove swatches; squeeze dry. Hang on line to dry at ambient temperature.

Evaluation:

Dry swatches may be evaluated both visually and tactilely. Comparisons are usually made to standard swatches consisting of no rinse-cycle treatment and/or treatment with a concentration of some common softening agent.

Concentration Factors:

This test is designed such that 0.01 g of softening agent (an active basis) will provide the same concentration of softening agent to fabric load as is normally encountered in typical laundering practice. For checking the softening/yellowing of new agents a concentration of 0.5 g is used. Agents are usually prepared as 1-2% solutions in 1:1 EtOH:deionized water to facilitate rapid solution and dispersal in the rinse water.

All swatches washed in 1.5 g Cold Power® type detergent 120° F. tap water.

Rinsed as follows in 32° C. tap water (1 liter) plus:

| Bucket | 1 | 2 | 3 | 4 |
|---|---|---|---|---|
| Swatch Code | A | B | C | D |
| Added | | 6.7 ml., 7.5% Varisoft 475 | 25 ml., 2% Example 2 | 50 ml., 1% Example 1 |

Softness rating:

Using a scale of A = 1 and B = 10, a first wash result is:

C = 10

D = 8

Yellowing: C and D are noticeably whiter than B.

Repeat of Experiment 1 using 0.7 ml., Varisoft 475, 5 ml., 2% Example 2 and 10 ml., 1% Example 1 for B2, C2, and D2respectively. Again softness ratings were:

A=1

B2=10 (yellow)

C2=9

D2=9

Compounds:

Example 1 = $[C_{17}H_{35}CONH(CH_2)_3\overset{+}{N}(CH_3)_2C_{18}H_{37}]Br^-$

Example 2 = $[C_{17}H_{35}COO(CH_2)_3\overset{+}{N}(CH_3)_2C_{18}H_{37}]Br^-$

Varisoft 475 =

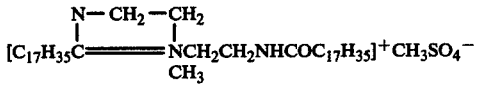

EXAMPLE XII

Machine Wash Test (3.0 g Softener per 8 lb. load)

Softeners:

Example 1, Example 2, Varisoft 475, Control (No Softener)

Conditions:

Load — 8 lb. clean items with 3 test Terrycloth Towels

Machine:

G.E., 10 minute — 49° C. wash in a commerical type laundry detergent powder containing 10% linear tridecylbenzene sulfonate, 2% ethoxylated alcohol, 1% soap, 33% tripolyphosphate, 7% silicate, 0.3% carboxymethyl cellulose, q.s. water, $Na_2SO_4$, (no brightener) at 0.15% conc. 3-minute rinse using 3.0 g (100% active ingredient) softener dissolved in 120 ml. 50% isopropanol except for control.

Evaluation:

Softness — Hand, (Varisoft 3.0 g per lb. load = 10); Yellowing — Gardner +b Value (Filter In)

| | Towel Softening | | | Towel Yellowing (+b Values) | | | |
|---|---|---|---|---|---|---|---|
| Evaluation Results | 1 | 2 | 3 | 1 | 2 | 3 | Avg. |
| Ex. 1 | 10+ | 9 | 10++ | 2.1 | 1.9 | 2.2 | 2.1 |
| Ex. 2 | 10+ | 10++ | 10+ | 1.6 | 2.6 | 2.4 | 2.2 |
| Varisoft | 10 | 10 | 10 | 2.3 | 2.0 | 2.2 | 2.2 |
| No Softener (Control) | 1 | 1 | 1 | 1.5 | 1.3 | 1.4 | 1.4 |

Conclusion:

At the levels noted above, compounds of Example I and II, soften at least as good as Varisoft, and better in certain instances.

EXAMPLE XIII

Machine Wash with one-half normal softener use conditions: Same conditions as XII except 1.5 g rather than 3.0 g of softener used.

| | Towel Softening | | | | Towel Yellowing +b Values | | | |
|---|---|---|---|---|---|---|---|---|
| Evaluation Results | 1 | 2 | 3 | Avg. | 1 | 2 | 3 | Avg. |
| Ex. 1 | 4 | 3 | 4 | 4 | 1.5 | 1.6 | 1.7 | 1.6 |
| Ex. 2 | 7 | 8 | 8 | 8 | 1.7 | 1.8 | 1.7 | 1.7 |
| Varisoft | 4 | 6 | 6 | 6 | 1.5 | 1.6 | 1.8 | 1.6 |

-continued

| | Towel Softening | | | | Towel Yellowing +b Values | | | |
|---|---|---|---|---|---|---|---|---|
| Evaluation Results | 1 | 2 | 3 | Avg. | 1 | 2 | 3 | Avg. |
| No Softener | 1 | 1 | 1 | 1 | 1.5 | 1.3 | 1.4 | 1.4 |

Conclusions: At this low softener concentration (1.5 g softener per 8 lb. load), Ex. 2 is a better softener than Varisoft.

EXAMPLE XIV

Two Towel Accelerated Softening and Yellowing Softeners:

Ex. 1, Ex. 2, Varisoft 475

Conditions:

Load — Two terrycloth towels

Machine — G.E., 10 minute — 49° C. wash in no brightener Ajax® (10-2-1-33% P) at 0.15% conc.

3 minute rinse using 0.5 g (100% active ingredient) of softener.

Evaluation:

Softness — Hand;

Yellowing — Gardner +b Values (Filter In)

| | Towel Softness | | Towel Yellowing (+b Values) | | |
|---|---|---|---|---|---|
| Evaluation Results | 1 | 2 | 1 | 2 | Avg. |
| Ex. 1 | 10+++ | 10++++ | 4.6 | 4.6 | 4.6 |
| Ex. 2 | 10+++ | 10++++ | 5.5 | 5.2 | 5.4 |
| Varisoft | 10++ | 10++ | 5.0 | 4.8 | 4.9 |

Conclusions:

The compounds of both Example I and II are better softeners than Varisoft.

We claim:

1. A compound having the formula $[C_nH_{2n+1}CO_R(CH_2)_mN^+(CH_3)_2C_pH_{2p+1}]X^-$ wherein R is a moiety selected from the group consisting of O and NH and n is an integer of about 11–22 and m is an integer of about 2–6, and p is an integer of 10–20 and X is an anion.

2. A compound as defined in claim 1 wherein X is selected from the group consisting of chloride, bromide, iodide, methosulfate, ethosulfate and alkyl arenesulfonate.

3. A compound as defined in claim 1 wherein n is 17, m is 3, p is 18 and X is bromide.

4. A fabric treating composition suitable for softening said fabrics comprising 1% to 25% by weight of the compound of claim 1 in combination with a component selected from the group consisting of an aqueous medium, a water-soluble anionic or nonionic synthetic organic detergent, an inorganic or organic detergent builder salt and mixtures thereof.

5. A fabric treating composition in accordance with claim 4 wherein said component is said detergent and the weight ratio of compound to detergent is about 1:1 to 1:10.

6. A fabric treating composition in accordance with claim 5 wherein said detergent is a nonionic detergent.

7. A fabric treating composition in accordance with claim 5 which contains in addition a water-soluble inorganic, alkali metal detergent builder salt in a weight ratio of compound to builder salt of 1:2 to 1:50.

8. A fabric treating composition in accordance with claim 4 wherein said component is an aqueous medium and said compound is present in an amount of 2% to 20% by weight.

9. A fabric treating composition in accordance with claim 8 which contains, in addition, 5% to 40% by weight of water-soluble anionic or nonionic synthetic organic detergent.

10. A method of softening fabrics comprising contacting said fabrics with water containing 0.001% to 0.010% by weight of the compound of claim 1.

11. A method in accordance with claim 10 wherein said compound is present in an amount of about 2 to 10 grams per 8 pounds of fabric.

* * * * *